US006663320B1

(12) United States Patent
Braud et al.

(10) Patent No.: US 6,663,320 B1
(45) Date of Patent: Dec. 16, 2003

(54) ANCHOR LINE CONNECTOR

(75) Inventors: Jean Braud, La Turbie (FR); Andrew Newport, La Turbie (FR)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 10/253,712

(22) Filed: Sep. 25, 2002

(51) Int. Cl.[7] ..... B63B 21/04; B63B 21/10

(52) U.S. Cl. ..... 405/224; 114/230.2; 114/230.28; 114/230.29

(58) Field of Search ..... 405/195.1, 224; 114/230.1, 230.2, 230.24, 230.25, 230.28, 230.29; 441/3–5

(56) References Cited

U.S. PATENT DOCUMENTS 5,842,434 A * 12/1998 Lange et al. ..... 114/230.12

FOREIGN PATENT DOCUMENTS

WO WO 0078599 A1 * 12/2000 ..... B63B/21/10

* cited by examiner

*Primary Examiner*—Thomas B. Will
*Assistant Examiner*—Tara L. Mayo
(74) *Attorney, Agent, or Firm*—Young & Thompson

(57) ABSTRACT

An offshore construction includes a floating body (1), at least one anchor line (2) for connecting the floating body to the sea bed, the anchor line being connected to the floating body via a flexible top part (4) which is attached to a connector (5) on the floating body. The connector includes a housing (9) having two mutually perpendicular pivot axes (10, 12) with an elongate tubular member (8) extending in the anchor line direction and a latch mechanism (15) for fixation of the anchor line to the floating body and preventing movement in the direction of the sea bed. The connector includes a rod (13), which can be accommodated within the tubular member. The rod is connected to the flexible top part. The rod includes a broad head part (4) for engaging with the latch mechanism (15) and a lower part (16) for engaging with the sidewall of the tubular member and having an attachment member (11) for attaching to the flexible top part (4), the rod being longer than the tubular member such that the attachment member is situated outside of the tubular member.

10 Claims, 3 Drawing Sheets

ANCHOR LINE CONNECTOR

BACKGROUND OF THE INVENTION

1. Field of the Invention

The present invention relates to an offshore construction comprising a floating body, at least one anchor line for connecting the floating body to the sea bed, the anchor line being connected to the floating body via a flexible top part which is attached to a connector on the floating body, the connector comprising a housing having two mutually perpendicular pivot axes with an elongate tubular member extending in the anchor line direction and a latch mechanism for allowing movement of the anchor line towards the floating body and preventing movement in the direction of the sea bed.

2. Description of Related Art

Such an offshore construction is known from WO 00/78599 in which a mooring buoy is disclosed which is anchored to the seabed in which the anchor chains are attached to the buoy via a pivoting chain receiving tube comprising a chain stopper by which the chain can be tensioned. By providing two orthogonal pivot axes for the chain tensioner, chain wear can be reduced and the tension in the chain upon movement of the buoy is decreased.

In the known construction, however, the upper chain link will be fixed in position by the chain stopper device whereas the adjacent chain link can still move. Due to the high tension within the chain and the friction between the fixed link in the known chain hawser and the moveable link, which is attached to the link fixed by the chain stopper, this moveable link will be subject to bending fatigue which may lead to chain failure of the link within the hawser.

SUMMARY AND OBJECTS OF THE INVENTION

It therefore is an object of the present invention to provide an anchor line connector in which anchor line fatigue in general is reduced.

It is also object of the present invention to provide a chain connector in which chain link fatigue and in particular chain link fatigue through out of plane bending is reduced.

Thereto, the offshore construction according to the present invention is characterized in that the connector comprises a rod which can be accommodated within the tubular member, which rod is connected to the flexible top part, the rod comprising a broad head part for engaging with the latch mechanism and a lower part for engaging with the sidewall of the tubular member and having an attachment member for attaching to the flexible top part, the rod being longer than the tubular member such that the attachment member is situated outside of the tubular member.

The flexible part, which is at the top end of the anchor line, could be a chain part or could be a steel wire or a polyester rope part with a lug at its free end. In case of the chain part, the end chain link is connected to the rod, which can then be inserted into the tubular member and can be fixed in place with its broadened head part behind the latch mechanism. The attachment member remains located outside of the tubular member such that the chain link attached to the rod can freely move. When the chain part reaches a predetermined angle, the tubular member will pivot upon reaching a predetermined break out torque, such that it will swing and reduce the interlink angle at the position near the connector and, hence, out of plane bending of the chain links.

In one embodiment, the rod comprises a broadened middle part for engaging with the wall of the tubular member. The broadened middle part distributes the forces exerted via the chain part on the tubular member, more evenly along its length.

The connector according to the present invention can be designed by first determing the allowable stress range on the chain links for the life of the mooring system, based on a fatigue approach. Thereafter, the angular movement between the links corresponding to the allowable stress range is determined. This is based on experimental stress analysis. Next, the minimum length of the tubular member and rod according to the present invention is determined to ensure that the tubular member is rotated before the maximum allowable angle of the chain links is reached. In order to limit the length of the tubular member, low friction bushes for the pivot axis are preferred.

The perpendicular pivot or gimble arrangement provides articulation in orthogonal directions. The articulation in the transverse direction is needed to limit the pressure on the bushes of the pivot axis, which provide articulation in the radial direction, as well as avoiding fatigue failure in transversely orientated links.

BRIEF DESCRIPTION OF THE DRAWINGS

Embodiments of the connector according to the present invention will be described in detail with reference to the accompanying drawings. In the drawings.

DETAILED DESCRIPTION OF PREFERRED EMBODIMENTS

Figure 1:
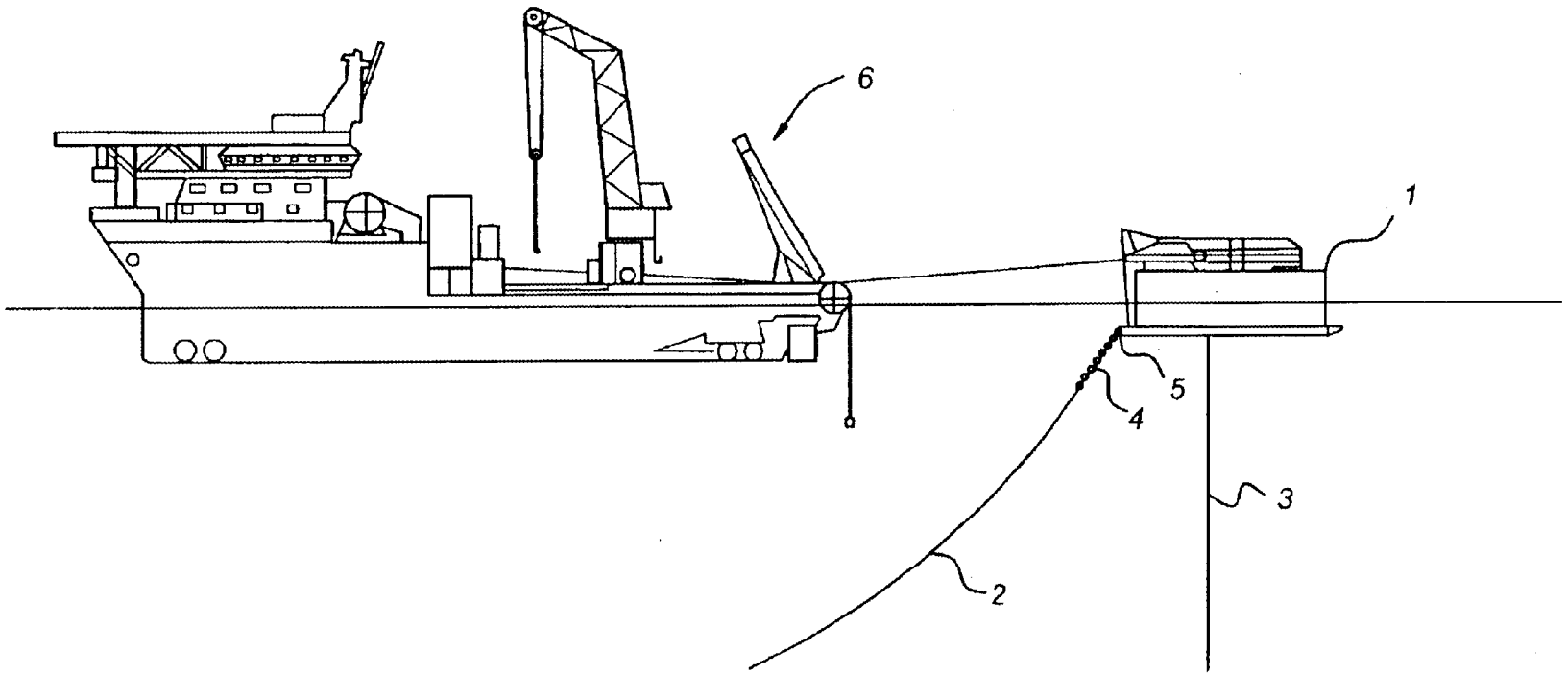
FIG. 1 shows a schematic side view of the installation of a single point mooring buoy comprising a connector according to one embodiment of the present invention.

FIG. 1 shows a single point mooring buoy 1, which is anchored to the seabed via mooring line 2. Hydrocarbon risers 3 extend between the seabed and the single point mooring buoy 1. At the top part of the mooring line a chain part 4 is provided which is attached to a pivoting connector 5 on the mooring buoy 1. The connector 5 comprises a latch mechanism allowing installation and fixation of the rod with the connected chain part by pulling a messenger line via the tube of the connector. The proper mooring line length adjustment and tension is obtained via the installation vessel 6 before installation of the rod into the connector. In order to limit out-of plane bending fatigue in the chain part 4, the connector 5 can pivot around a pivot axis that is perpendicular to the plane of the drawing, such that the mooring line 2 can move in a radial plane (the plane of the drawing).

Figure 2:
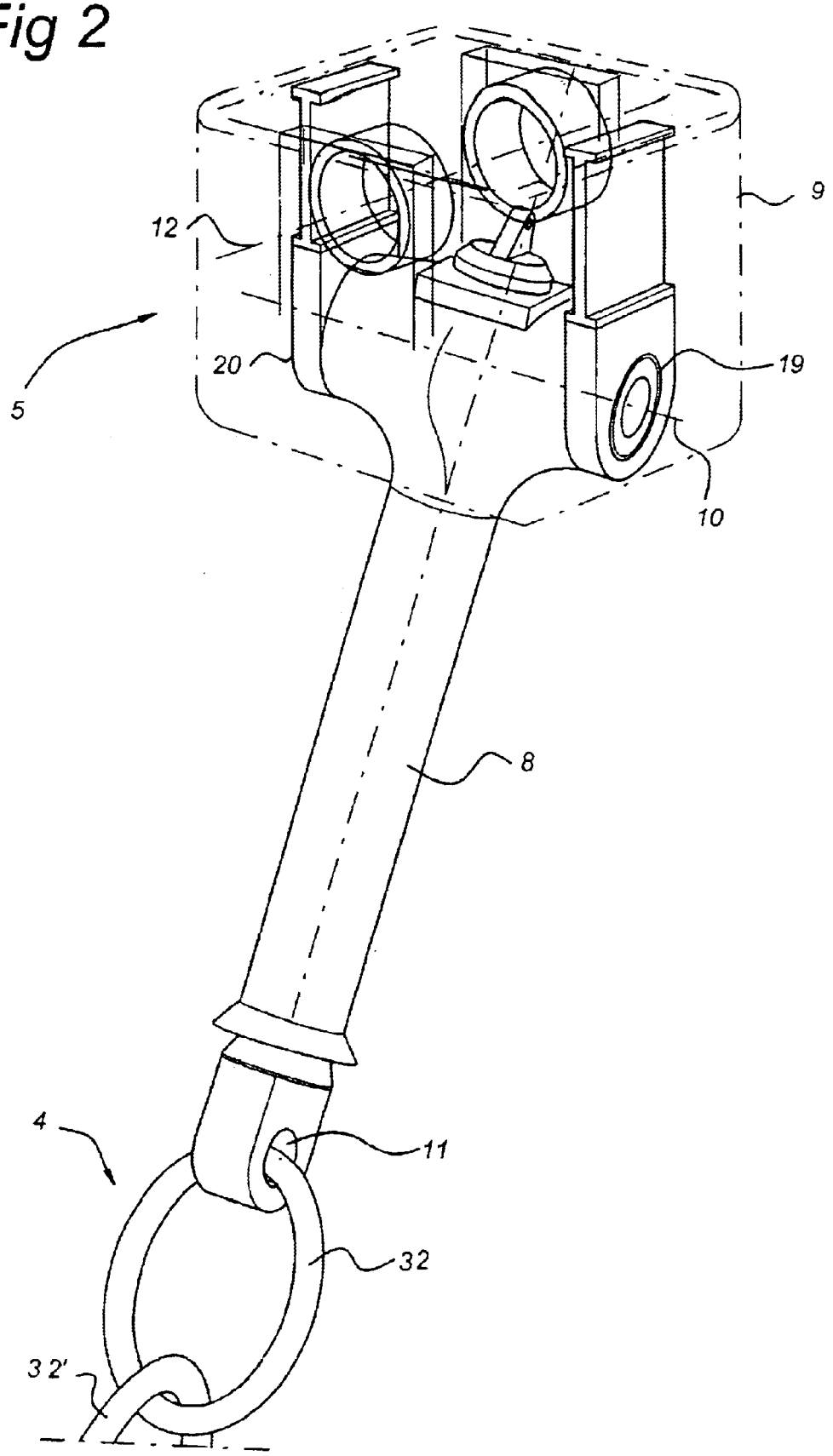
FIG. 2 shows a perspective view of the connector of FIG. 1 in which the housing has been omitted for clarity.

FIG. 2 shows a schematic perspective view of the connector 5 showing a tubular member 8 which is connected to a housing 9 and which is rotatable in a radial plane around first pivot axis 10. In the hollow tubular member 8 a rod is comprised having an attachment member 11 located outside of the rod 8, which is attached to the chain links 32 of the chain part 4.

The length of the arm 8 is designed such that before the chain links 32 reach the maximum angle of deflection, the break out torque is reached and rotation around axis 10 occurs such as to align the arm 8 with the general direction of the chain links 12. In this way, fatigue due to out of plane bending of chain links 32 is reduced. By being able to pivot around the second pivot axis 12, the pressure on the bushes 19, 20 of the pivot joint is reduced and fatigue failure in transversely oriented links 12' is prevented.

Figure 3:
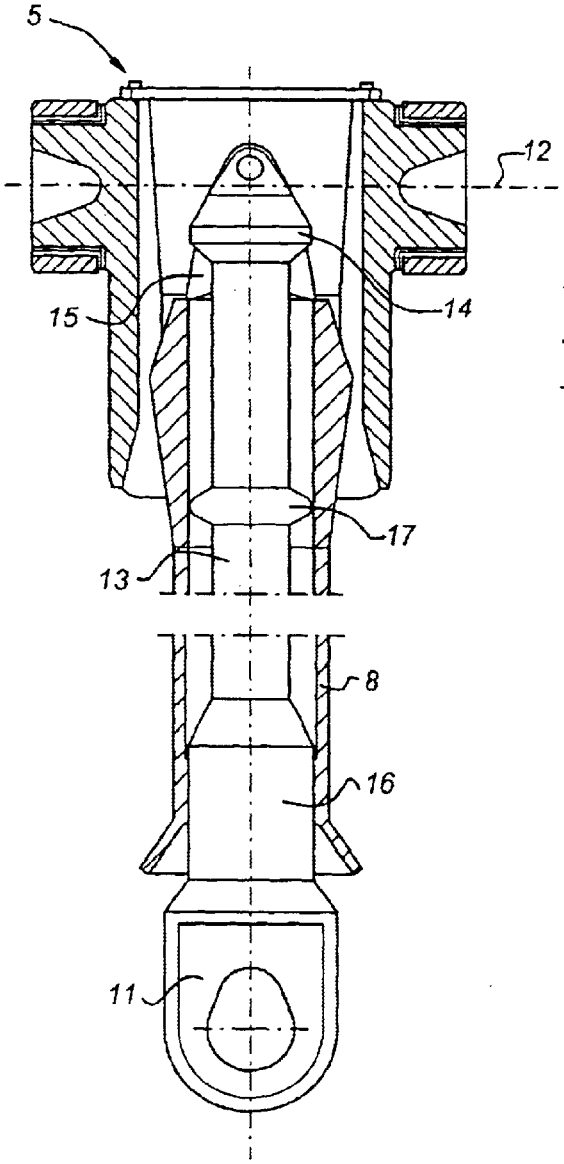
FIG. 3 shows a cross-sectional view in the radial plane of the connector according to FIG. 1.

FIG. 3 shows a cross-section in the radial plane of the connector 5. It can be seen that the rod 13 is inserted inside the tubular member 8, a broadened head part 14 being engaged by a latch mechanism 15. Upon installation, the head part 14 is attached to a cable running through the tubular member 8 and is pulled upwards into the tubular member 8 until it passes the latch mechanism 15, which then moves back in position and locks the rod 13 in place. A lower part 16 of the rod 13 and a middle part 17 engage with the sidewall of tubular member 8 for even force distribution from the rod to tubular member 8.

Figure 4:
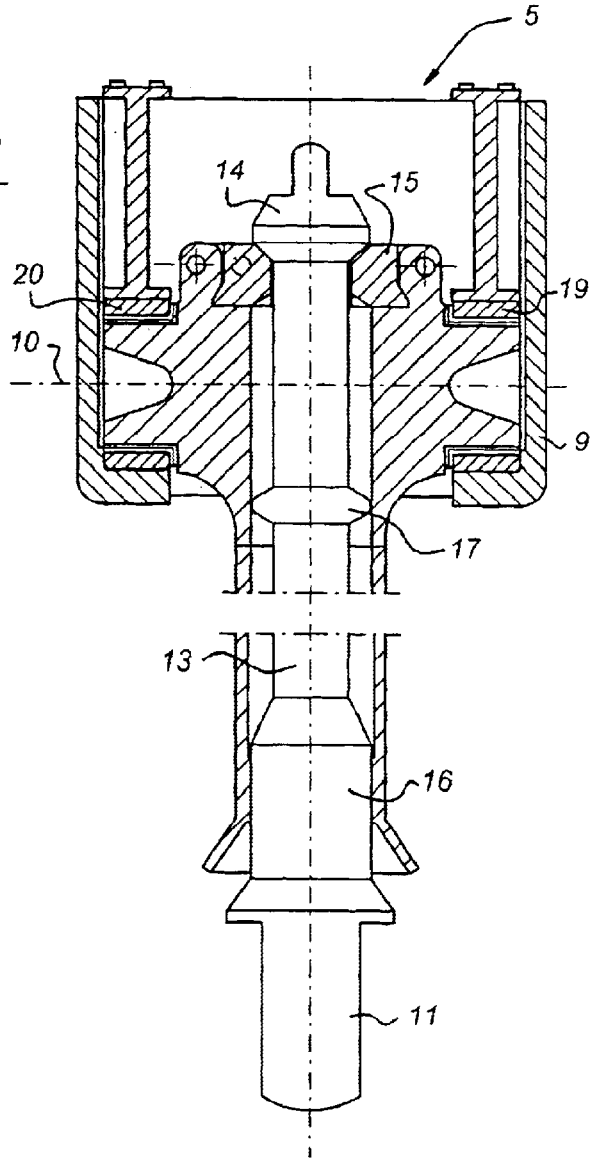
FIG. 4 shows a cross-sectional transverse plane of the connector according to FIG. 1.

FIG. 4 shows a cross-section through the connector showing the radial pivot axis 10 and the mounting of pivot bushes 19 and 20 within housing 9. Preferably, the bushes 19 and 20 are constructed of low friction material, such as Xytrex. Even through the pivot axis 10 and 12 are shown to be located at different positions along the length direction of the tubular member 8, they can also be located on the same height, i.e. in an intersecting manner. The housing 9 of the connector 5 is attached to the buoy 1 in a conventional manner and can fit in commonly known chain hawser support structures. The connector can be used on offshore structures such as turret moored constructions, spread moored vessels, catenary anchor leg mooring (CALM) buoys, semi-submersibles, SPARS or other offshore constructions.

While the present invention has been described above in connection with several preferred embodiments thereof, it is to be expressly understood that those embodiments are provided solely for the purpose of illustrating and promoting an understanding of the invention, and are not to be construed in a limiting sense. After reading this disclosure, those skilled in this art might readily envision insubstantial modifications and substitutions of equivalent materials and techniques, and all such modifications and substitutions are considered to fall within the true scope of the appended claims.

What is claimed is:

1. Offshore construction comprising a floating body (1), at least one anchor line (2) for connecting the floating body to the sea bed, the anchor line being connected to the floating body via a flexible top part (4) which is attached to a connector (5) on the floating body, the connector comprising a housing (9) having two mutually perpendicular pivot axes (10, 12) with an elongate tubular member (8) extending in the anchor line direction and a latch mechanism (15) for fixation of the anchor line to the floating body and preventing movement in the direction of the sea bed, wherein the connector comprises a rod (13) which can be accommodated within the tubular member, which rod is connected to the flexible top part, the rod comprising a broad head part (14) for engaging with the latch mechanism (15) and a lower part (16) for engaging with the sidewall of the tubular member and having an attachment member (11) for attaching to the flexible top part (4), the rod being longer than the tubular member such that the attachment member is situated outside of the tubular member.

2. Offshore construction according to claim 1, wherein the rod (13) comprises a broadened middle part (17) for engaging with the wall of the tubular member.

3. Offshore construction according to claim 2, wherein the head part (14) is tapered.

4. Offshore construction according to claim 2, wherein the tubular member (8) has a length determined such that said tubular member hinges around one of the two pivot axes (10) when the flexible top part reaches a predetermined threshold angle.

5. Offshore construction according to claim 2, wherein the flexible top part of the anchor line is a chain part.

6. Offshore construction according to claim 1, wherein the head part (14) is tapered.

7. Offshore construction according to claim 6, wherein the tubular member (8) has a length determined such that said tubular member hinges around one of the two pivot axes (10) when the flexible top part reaches a predetermined threshold angle.

8. Offshore construction according to claim 6, wherein the flexible top part of the anchor line is a chain part.

9. Offshore construction according to claim 1, wherein the tubular member (8) has a length determined such that said tubular member hinges around one of the two pivot axes (10) when the flexible top part reaches a predetermined threshold angle.

10. Offshore construction according to claim 1, wherein the flexible top part of the anchor line is a chain part.

* * * * *